United States Patent [19]

Yung

[11] Patent Number: 4,835,933

[45] Date of Patent: Jun. 6, 1989

[54] REBAR SPACER ASSEMBLY

[76] Inventor: Fernand P. Yung, 927 S. Laurel St., Santa Ana, Calif. 92704

[21] Appl. No.: 155,223

[22] Filed: Feb. 11, 1988

[51] Int. Cl.[4] ..... F04C 5/16

[52] U.S. Cl. ..... 52/685; 52/687; 52/689; 248/74.4

[58] Field of Search ..... 52/677–689, 52/719; 248/74.3, 74.4, 74.1, 505, 221.4

[56] References Cited

U.S. PATENT DOCUMENTS

| | | | |
|---|---|---|---|
| 1,921,538 | 8/1933 | Priest | 52/685 |
| 2,064,705 | 12/1936 | Whitehead | 52/685 |
| 3,447,277 | 6/1969 | Korf | 52/687 |
| 3,673,753 | 7/1972 | Anderson | 52/685 |
| 4,655,023 | 4/1987 | Yung | 52/685 |

FOREIGN PATENT DOCUMENTS

| | | | |
|---|---|---|---|
| 1285709 | 12/1968 | Fed. Rep. of Germany | 52/686 |
| 2831608 | 1/1980 | Fed. Rep. of Germany | 52/687 |
| 470555 | 5/1969 | Switzerland | 52/686 |

*Primary Examiner*—David A. Scherbel
*Assistant Examiner*—Richard E. Chilcot, Jr.
*Attorney, Agent, or Firm*—Gausewitz, Carr & Rothenberg

[57] ABSTRACT

A spacer assembly including a spacer with a body having a base portion with a generally centrally disposed support post portion, one end which is formed as a planar surface with a centrally located generally concave saddle portion configured for receiving a reinforcing bar, the planar surface being provided with apertures therethrough on both sides of the saddle. A clamp member is provided for simultaneously securing mutually perpendicular rebars to the chair, the clamp member including a generally U-shaped lower portion, with the depending arms thereof in spaced generally parallel relation for engaging a first bar within the saddle. A pair of generally identical hook arms extending upwardly from the bight portion, the hook arms being oriented for engaging a second rebar in an orientation perpendicular to a first rebar engaged within the saddle portion. The saddle portion is configured with a centrally disposed opening therein, and an incremental spacer or extender member is provided, for mating coaction with the uppermost part of the support post. The extender member is one of a set of extender members wherein the spacer can be fabricated in whole sizes, such as two inch, three inch, etc., and the extender members can be fabricated in fractional sizes, such as one-quarter, one-half and three-quarter inch sizes.

29 Claims, 2 Drawing Sheets

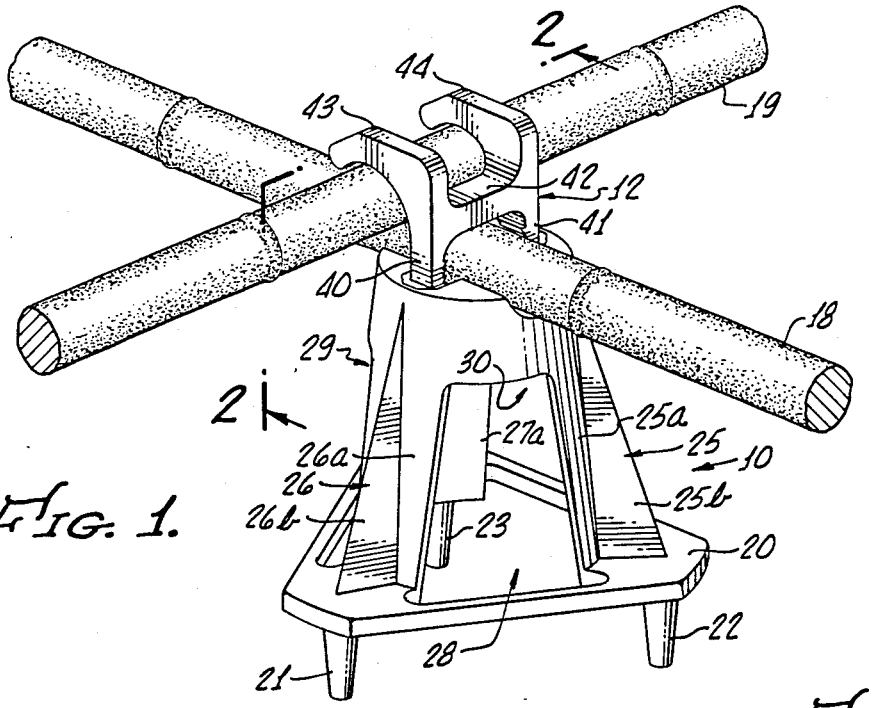
FIG. 1.
FIG. 2.
FIG. 4.
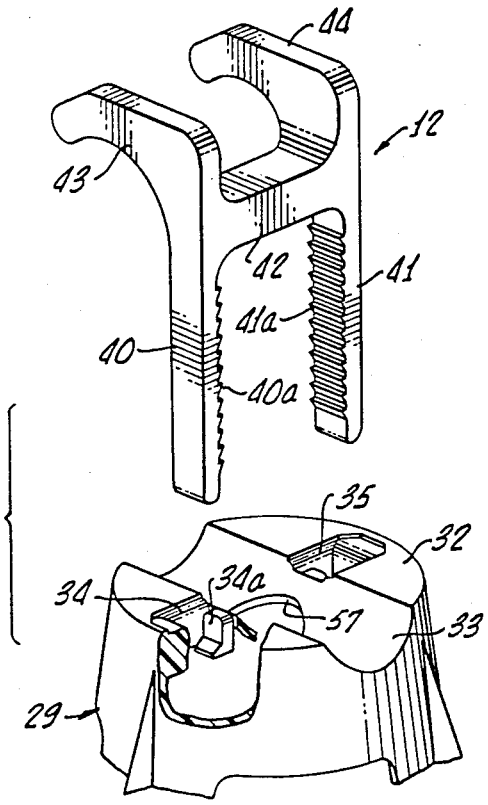
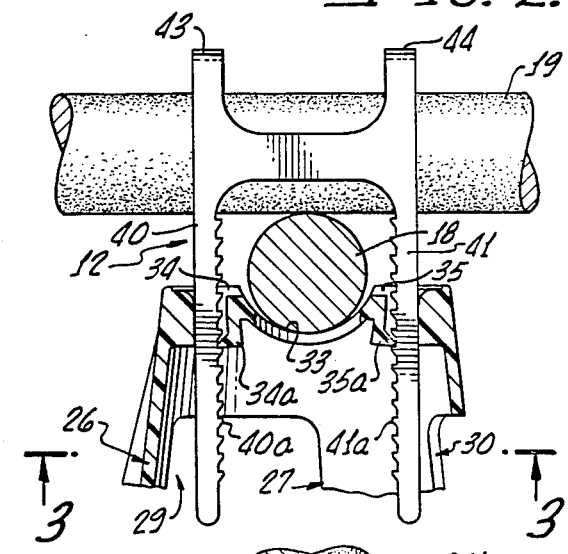
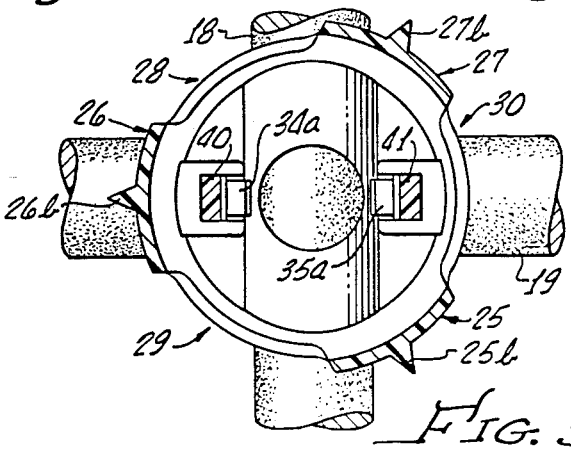
FIG. 3.

FIG. 5.
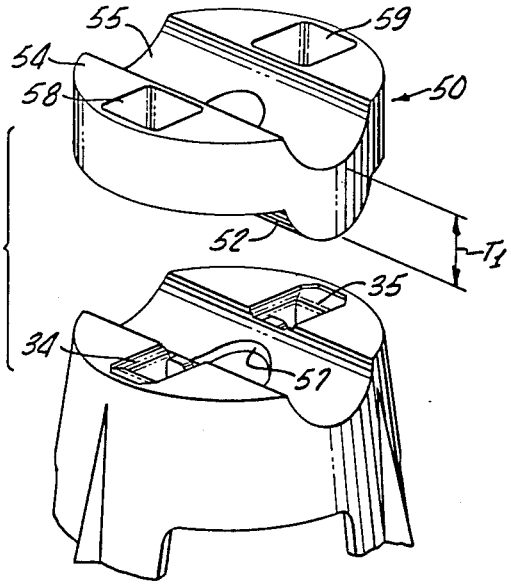
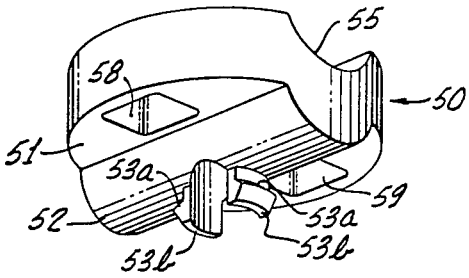
FIG. 6.
FIG. 8.
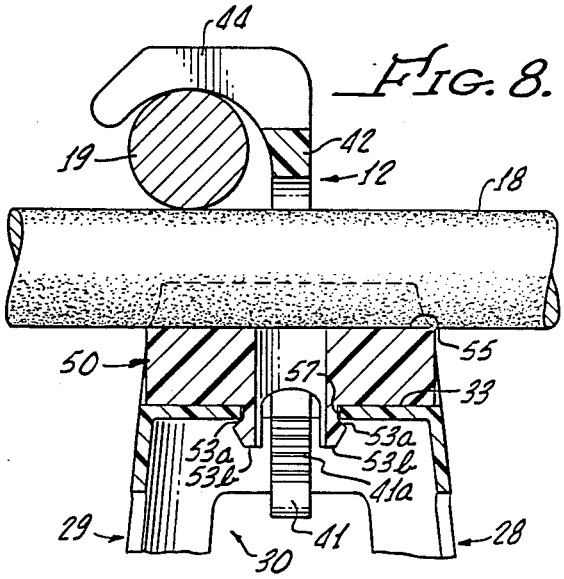
FIG. 7.
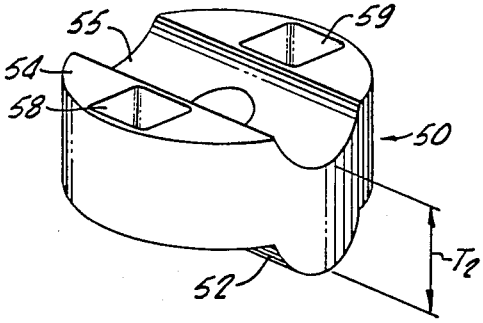
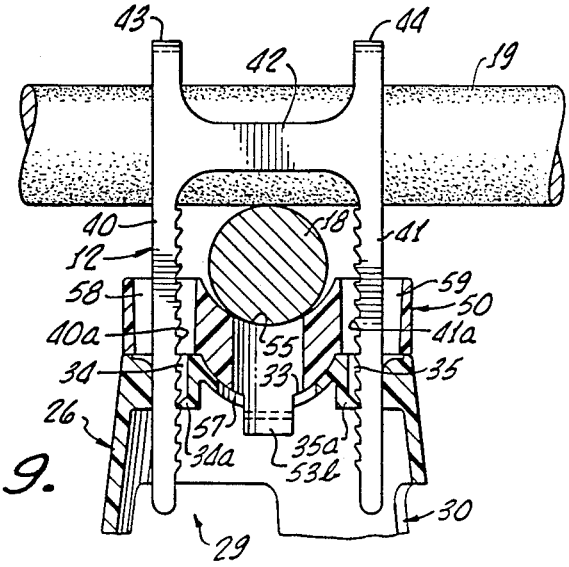
FIG. 9.

REBAR SPACER ASSEMBLY

BACKGROUND OF THE INVENTION

The background of the invention will be discussed in two parts:

1. Field of the Invention

This invention relates to devices for use in connection with construction, and more particularly to a reinforcing bar chair apparatus for use in reinforced concrete construction.

2. Description of the Prior Art

In reinforced concrete construction applications, such as highways, or in the floors, or in the walls of buildings, spacer devices, commonly referred to as chairs, are required for supporting and maintaining reinforcing rods or bars which are positioned in the area where the concrete is to be poured. These reinforcing rods are sometimes referred to as "rebars". Depending on such parameters as the total surface area and the thickness of the end product of concrete, reinforcement is mandated in varying degrees by building codes. One such method of reinforcement involves a steel mesh, while in major concrete construction, such as highways, and for high-rise buildings, reinforcing rods of various diameters, typically one half inch or more, are required. In addition, on such jobs, the reinforcing bars may be positioned in spaced layers due to the thickness of the floor, for example. In some installations, a first layer of rebar is provided, with the reinforcing rods or rebars in spaced parallel relation, that is, they are parallel to each other, and generally parallel to the surface on which the concrete is to be poured. A second layer of rebar is then added, with the orientation of the second layer perpendicular to the first layer, thus forming a grid or lattice work or rebar. After the reinforcing bars or lattice work is prepared, the concrete is then poured over this grid or framework, which is ultimately embedded within the highway, floor or wall.

By way example, for a concrete floor on a prepared surface, spacers or chairs are utilized for providing the vertical separation of the rebar grid from the surface on which the concrete is to be poured. The prepared surface may be a wood or plywood structure or form, or may be a compacted surface, the latter of which may be provided with a layer of compacted sand, with a plastic sheet covering thereon providing a moisture barrier. Spacers or chairs are positioned on the prepared surface for supporting the rebars in a plane generally parallel to the prepared surface. Typically, with modern building codes, a spacer is needed every lineal foot of the rebar.

Such spacers are also utilized in forming walls, such as in the construction of buildings referred to as concrete tilt-up structures. With prior art metallic rebar chairs, after the wall is poured and sets, all sets, all spacer or chair locations are checked for exposure of any portion of the chair at the surface of the wall. All of such exposed metallic edges are ground and then sealed to protect the formation of rust, which attacks the metal of the rebar or chair on the interior of the wall, causing structural weaknesses.

Some prior art spacers or chairs have been formed of plastic material and one such spacer includes a pair of generally identically configfured rectangular plate members having a height equal to the spacing needed. Each plate includes a longitudinally extending slot of a width generally equal to the width of the plate member. The slots are interconnected in egg-crate manner to form a spacer of cruciform cross-section. One or both of the plates will have at least one hole extending therethrough for receiving a piece of wire which is passed through the hole and about the rebar resting on the spacer, the wire then being twisted to secure the rebar on the spacer.

Another such plastic spacer is shown and described in Applicant's issued U.S. Pat. No. 4,655,023, entitled "Spacer for Construction Use", which issued on Apr. 7, 1987.

With rebar spacers or chairs, one common problem is occasioned by the number of different sizes required to be maintained by a supplier to accommodate different thicknesses of poured concrete, such as two inch, three inch, four inch, etc. and many intermediate fractional sizes. Another common problem with rebar spacers has been encoutered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire is used for securing the perpendicular layer of rebar.

With any metal or wire within the reinforcing bar grid work, there is a problem with rusting or decomposition of the wire or metal elements.

In accordance with an aspect of the invention, it is an object of the present invention to provide a new and improved spacer or chair assembly for use in concrete construction applications, particularly adapted for use with reinforcing rods in a single layer or in multiple layers in reinforced concrete construction.

SUMMARY OF THE INVENTION

The foregoing and other objects of the invention are accomplished by providing a spacer assembly including a spacer with a body having a base portion with a generally centrally disposed support post portion. One extremity of the support post portion is formed as a planar surface with a centrally located generally concave saddle portion configured for at least partially receiving a reinforcing rod therein for partial support of the rebar or rod. The planar surface is provided with apertures therethrough on both sides of the saddle. A retainer or clamp member is provided for simultaneously securing mutually perpendicular rebars to the chair, with one rebar within the saddle. For this purpose, the clamp member includes a generally U-shaped lower portion, with the depending arms thereof in spaced generally parallel relation, with the inner facing surfaces thereof having barbs or tange for frictional engagement within the aperture of the post portion of the chair. A pair of generally identical hook arms extend upwardly from the bight portion, with the hook arms being spaced and generally parallel to one another, the engaging portion of the hook arms being oriented for engaging a second rebar in an orientation perpendicular to a first rebar engaged within the saddle portion. The saddle portion is configured with a centrally disposed opening therein, and an incremental spacer or extender member is provided, for mating coaction with the uppermost part of the support post. The extender member has depending tangs on the lower part thereof for captive engagement with the central opening, with a pair of slotted openings through the body thereof for axial alignment with the apertures of the support post portion for enabling passage of the barbed arms of the clamp member therethrough. With the extender member, the chair can be fabricated in whole sizes, such as two inch, three inch, etc., and the extender members can be fabricated in fractional sizes, such as one-quarter, one-half and three-quarter inch sizes.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the spacer assembly according to the invention, with reinforcing bars thereon;

FIG. 2 is a cross-sectional view of the spacer assembly of FIG. 1 in assembled relation as viewed generally along line 2—2 thereof;

FIG. 3 is a cross-sectional bottom view of the spacer assembly of FIG. 1 as viewed generally along line 3—3 of FIG. 2;

FIG. 4 is an exploded perspective partial view, partially broken away, of the clamp member and upper part of the spacer of the spacer assembly of FIG. 1;

FIG. 5 is an exploded perspective partial view, of the upper part of the spacer of the spacer assembly of FIG. 1, with an extender member;

FIG. 6 is a bottom perspective view of the extender member shown in FIG. 5;

FIG. 7 is a top perspective view of the extender member shown in FIGS. 5 and 6;

FIG. 8 is a cross-sectional view showing the interconnection of the extender member to the upper part of the spacer of the spacer assembly of FIG. 1, with the clamp member and bar members assembled thereon; and FIG. 9 is a partial cross-sectional view of the spacer assembly of FIG. 8 as viewed along a line generally perpendicualr to the cross-section line of FIG. 8.

DESCRIPTION OF THE PREFERRED EMBODIMENT

Referring now to the drawings, and particularly to FIG. 1, there is shown a spacer assembly which includes a spacer, generally designated 10, and a clamp member, generally designated 12 attached thereto, with portions of first and second reinforcing bar members 18 and 19, secured in intersecting or perpendicular relation to the spacer 10 by clamp member 12.

The spacer 10 is a unitary member molded as a shell-shaped framework, which includes a base or plate portion 20 of triangular peripheral configuration with an enlarged opening. A plurality of downwardly depending feet 21–23 extend from the undersurface of the plate portion 20 at the corners thereof. The feet 21–23 are configured for engagement with a sand plate (not shown) and may be omitted. The other side of the plate portion 20 has integrally formed therewith a frustoconically configured support post portion, configured in the form of an inverted bucket or pail with an open interior. The support post portion includes three leg members 25–27, each of which includes a first part or wall portion 25*a*–27*a* which is a relatively thin wall and part of the surface of the frustum, with parts of the surface removed at openings 28–30, respectively. Each leg member 25–27 is reinforced with an integrally formed radially extending web or spine portion 25*b*–27*b*, which is triangularly configured, the base of which extends into and merges with the upper surface of the plate portion 20 in alignment with the corresponding corner of the triangle formed thereby. In this manner, each leg member 25–27 may have the wall portion 25*a*–27*a* of relatively small thickness for the weight to be supported, with the generally perpendicular reinforcing rib or spine portion 25*b*–27*b* being relatively thin and providing additional structural strength. The breadth of the openings 28–30, and the enlarged opeining in the plate portion 20 facilitate flow of concrete into the hollow space within the framework of the spacer 10.

The upper part of the post portion is configured to provide a rebar engagement surface, which is formed as a generally horizontal planar surface 32, which surface is perpendicular to the vertical central axis of the frustum. The surface 32, in plan view, is circular, of relatively small thickness, and includes saddle means, in the form of a diametrically extending concave groove or saddle 33 configured for at least partially receiving a bar member 18 therein. On both sides of the saddle 33, the surface 32 is provided with slot means or apertures 34, 35 extending therethrough, with each aperture 34, 35 having a coacting integrally formed deflectable tang arm member 34*a*, 34*b*, in coacting relation within the slot adjacent the inner edges thereof.

The clamp member 12 has first means for retaining the lower bar member 18 within the saddle 33 atop the post portion with second means for retaining the upper bar member 19 atop the lower bar member 18 in perpendicular relation therewith. By reference to FIGS. 2 through 4, the clamp member 12 has the lower portion thereof configured as an inverted generally U-shaped portion with first and second legs 40, 41 and a bight portion 42 interconnecting the legs 40, 41. The aforementioned first means of the clamp member 12 are defined by the area within the boundaries established by the bight portion 42 and the legs 40, 41. The legs 40, 41 are generally parallel with the spacing therebetween greater than the width or diameter of the reinforcing bar member 18. the length of the legs 40, 41 are sufficient for coaction with the apertures 34, 35, as will be described.

To provide the second means, the clamp member 12 includes hook portions formed by extending legs 40, 41 from the bight portion 42 to the opposite side thereof to form hook members 43, 44, which extend in a direction perpendicular to the plane of the first means, that is the legs 40, 41, and the bight portion 42. The inner coacting edges of the hook members 43, 44 are contoured to a diameter approximating that of the bar members 18, 19.

For securing the clamp member 12 to the spacer 10, the inner facing surfaces 40*a*, 41*a*, of the legs 40, 41 are serrated, the serrations being disposed laterally, that is, across the with thereof, with the length of the serrated surface encompassing the majority of the inner surfaces of the legs 40, 41. These serrations are positioned and adapted for coacting frictional engagement with the tang ends of the tang member arms 34*a*, 35*a*, when the legs 40, 41 are inseted into the apertures 34, 35 of the support post portion of the spacer 10.

For assembly of the rebar members 18, 19, to the spacer 10, the spacers 10 are positioned on the supporting surface in accordance with the pattern for the area to be covered. For example, for some construction, a rebar support or spacer 10 is positioned at one foot intervals along the length, with additional rows spaced one foot apart. The spacers 10, in a given row, are positioned with the saddles 33 in aligned relation, that is they are oriented to form a line for receiving a length of rebar 18. The rebar member 18 is then positioned in the aligned saddles 33 of the aligned spacers 10. At this point, the clamp member 12 may be partially secured by inserting the legs 40, 41 into the apertures 34, 35 of the spacer 10. After the other rows of rebar members 18 are suitably positioned on spacers 10, the intersecting row of rebar members 19 is positioned, one at a time of form a grid. A second bar member 19 is then positioned atop the existing first bar member 18, moved laterally beneath the hook portions 43, 44, and the clamp member 12 is then pushed down until either the upper bar member 19 abuts against the lower bar member 18 or until the bight portion 42 of clamp member 12 abuts against the bar member 18 to secure the two bar members 18, 19 to the spacer 10.

Both the spacer 10 and clamp member 12 are unitary members formed of suitable material, such as molded plastic material of suitable composition for the use. By way of example, the spacer 10 may be configured to support 200 or more pounds in compression.

Such spacers may be formed for different heights, such as two inch, three inch, four inch or more, the height corresponding to the spacing desired between the rebar and the supporting surface. As with any product, the more sizes that are required, the higher the initial capital outlay for tooling and molds, and The greater the inventory required. To facilitate the manufacture of spacers 10, and to minimize the inventory required, while providing fractional as well as integral sizes, in accordance with the invention, there is provided an incremental spacer or extender member 50.

By reference of FIGS. 5 through 9, the extender member 50 is a generally solid generally disc-shaped member, with the diameter thereof corresponding to the diameter of the post portion surface 32. The lower surface (See FIG. 6) of the extender member 50 is configured to the contour of the upper part of the post portion, for mating abutting relation with substantially the entire surface thereof. For this purpose, the lower surface includes a planar portion 51, with a concave diametrically extending projection 52 of generally semicircular cross-section, the radius of which corresponds to the radius of the saddle 33. As shown in FIGS. 8 and 9, with the extender member placed in position atop the post portion of the spacer 10, the planar portion 51 and the projection 52 closely abut the matingly configured surface 32 and saddle 33 of the spacer 10.

The upper surface of the extender member 50 (See FIG. 7) is a substantial duplicate of the upper contour of the post portion of the spacer member 10, with the upper and lower surfaces of the extender member 50 being in substantially parallel orientation. The upper surface includes a generally planar portion 54 with a diametrically extending saddle 55.

For enabling interconnection of the extender member 50 to the spacer 10, the spacer 10, as shown in FIGS. 5, 8 and 9, includes a centrally disposed generally circular aperture 57 within the saddle 33 with the center of aperture 57 on the verticall axis of the frustum of the post portion of spacer 10. Correspondingly, the undersurface of the extender member 50 includes a pair of downwardly depending diametrically disposed arms **53*a*, the outer surfaces of which generally define a cylindrical configuration of a diameter generally corresponding to the diameter of the aperture 57. The distal ends of arms 53*a* include outwardly extending generally wedge-shaped portions or projections 53*b* configured for enabling deflection of the arms 53*a* inwardly upon displacement of the extender member 50 toward the aperture 57**.

The extender member is formed, such as by molding, from a plastic material, with the arms **53*a* being deflectable and somewhat resilient, to permit inward deflection upon insertion and return to the outer positions after insertion, until the parts assume the positions shown in FIGS. 8 and 9, that is with the extender member 50 captively retained atop the support post portion with the lower surface of extending member in mating abutting engagement with the upper contoured surface of the support post portion of spacer 10. The upper surface of the extender member then becomes the surface of attachment of the rebar members 18 and 19**.

The captive retention of the extender member 50 to the spacer 12 may also be accomplished by other suitable means without use of the specific configuration of arms **53*a* with the coacting aperture 57**.

For enabling attachment of the clamp member 12, the extender member 50 is provided with a pair of spaced slotted openings 58 and 59 through the thickness thereof in diametrically opposed positions, with the slotted openings 58 and 59 in general alignment with the slot means of apertures 34 and 35, respectively, of the spacer 10. As shown more clearly in FIG. 9, the slotted openings 58, 59 are of slightly larger dimension than the dimension of apertures 34, 35 to facilitate insertion of the legs 40, 41 of the clamp 12 therein. After insertion of the legs 40, 41 of clamp 12, the serrated inner surfaces **40*a*, 41*a* of legs 40, 41 detentingly engage the barbed ends of tang arms 34*a*, 35*a* within apertures 34, 35. It is to be understood that the function of the openings 58 and 59 may also be readily performed by simply providing diametrically opposed cutouts in the extender member 50 at the slot locations, with the size of the cutouts being selected to permit access to the legs 40, 41 of the clamp member 12**.

As shown in FIGS. 8 and 9, the legs 40, 41 of clamp member 12 are sufficient in length to enable insertion through the extender member 50 while engaging the tang arms **34*a*, 35*a*, with first and second rebar members 18 and 19 attached in position atop the upper surface of the extender member 50**.

For manufacturing purposes, the spacers 10 may be formed in convenient heights, such as integral inch dimension, that is, two inch, three inch, etc., and the extender members 50 may be manufactured in incremental or different fractional thicknesses, such as $T_1$ (See FIG. 5) or $T_2$, each of these thicknesses being different. By way of example, if the spacers are formed in two inch, three inch or four inch size, the extenders may be formed in one-quarter inch, one half inch, and three-quarter inch size to enable one-quarter inch dimensional increments in height for the total spacer assembly, including spacer 10, with one of the desired thicknesses of extender 50. Since the extenders 50 are smaller in overall volume, storage of extenders is less of a problem than storage of spacers 10, and numerous different size spacer assemblies may be readily accommodated with a minimum inventory.

While there has been shown and described a preferred embodiment, it is to be understood that various other adaptations and modifications may be made within the spirit and scope of the invention.

I claim:

1. In a spacer assembly for use in construction applications for supporting reinforcement bar members relative to a supporting surface for concrete construction, the combination comprising:

a spacer member configured for positioning relative to the supporting surface, said spacer member having saddle means for receiving a reinforcement bar member at least partially thereon;

a separate unitary clamp member having first and second leg portions;

coacting means on said clamp member and said spacer member for attaching said leg portions of said clamp member to said spacer member adjacent said saddle means, said clamp member including first means including said leg portions for fastening a first bar member at least partially within said saddle means, and second hook means for fastening a second bar member to said spacer member in intersecting relation to and atop said first bar member.

2. In a spacer assembly for use in construction applications for supporting reinforcement bar members relative to a supporting surface for concrete construction, the combination comprising:

a spacer member configured for positioning relative to the supporting surface, said spacer member having saddle means for receiving a reinforcement bar member at least partially thereon;

a unitary clamp member, said clamp member including a first generally U-shaped portion with a bight portion and first and second leg portions;

coacting means on said clamp member and said spacer member for attaching said clamp member to said spacer member adjacent said saddle means, said clamp member including fist means for fastening a first bar member at least partially within said saddle means, and second means for fastening a second bar member to said spacer member in intersecting relation to and atop said first bar member, and wherein said coacting means includes first and second slot means in said spacer member for receiving said leg portions.

3. The spacer assembly according to claim 2 wherein said first and second leg portions are generally parallel and spaced a distance greater than the cross-dimension of said first bar member, and wherein said first means of said clamp member includes the space between said leg portions and said bight portion.

4. The spacer assembly according to claim 3 wherein said second means of said clamp member includes hook means for engaging the second bar member.

5. In a spacer assembly for use in construction applications for supporting reinforcement bar members relative to a supporting surface for concrete construction, the combination comprising:

a spacer member configured for positioning relative to the supporting surface, said spacer member having saddle means for receiving a reinforcement bar member at least partially thereon;

a unitary clamp member, said clamp member including a first generally U-shaped portion with a bight portion and first and second leg portions;

coacting means on said clamp member and said spacer member for attaching said clamp member to said spacer member adjacent said saddle means, said clamp member including first means for fastening a first bar member at least partially within said saddle means, and second means for fastening a second bar member to said spacer member in intersecting relation to and atop said first bar member, and wherein said first and second leg portions are generally parallel and spaced a distance greater than the cross-dimension of said first bar member, and wherein said first means of said clamp member includes the space between said leg portions and said bight portion, and wherein said second means of said clamp member includes hook means for engaging the second bar member.

6. The spacer assembly according to claim 1 wherein said spacer member includes a support post portion with said saddle means formed in a surface of said post portion.

7. In a spacer assembly for use in construction application for supporting reinforcement bar member relative to a supporting surface for concrete construction, the combination comprising:

a spacer member configured for positioning relative to the supporting surface, said spacer member including a support post portion and having saddle means formed in a surface of said post portion for receiving a reinforcement bar member at least partially thereon;

a unitary clamp member including a first generally U-shaped portion with a bight portion and first and second leg portions;

coacting means on said clamp member and siad spacer member for attaching said clamp member to said spacer member adjacent said saddle means, said coacting means including aperture means extending through said post portion for receiving said leg portions insertion through said aperture means, said clamp member including first means for fastening a first bar member at least partially within said saddle means, and second means for fastening a second bar member to said spacer member in intersecting relation to and atop said first bar member.

8. The spacer assembly according to claim 7 wherein said first means of said clamp member is the area defined by said leg portions and said bight portion.

9. The spacer assembly according to claim 8 wherein said second means of said clamp member includes hook means.

10. The spacer assembly according to claim 9 wherein said hook means includes first and second spaced hook arms integrally formed with said clamp member.

11. In a spacer assembly for use in construction applications for supporting reinforcement bar members relative to a supporting surface for concrete construction, the combination comprising:

a unitary clamp member having first and second spaced leg portions;

a spacer member configured for positioning relative to the supporting surface, said spacer member including a support post portion and having saddle means formed in a surface of said post portion for receiving a reinforcement bar member at least partially thereon, and wherein said spacer member includes aperture means extending through a surface including said saddle means;

coacting means on said clamp member and said spacer member for attaching said clamp member to said spacer member adjacent said saddle means, said clamp member including first means for fastening a first bar member at least partially within said saddle means, and second means for fastening a second bar member to said spacer member in intersecting relation to and atop said first bar member, and wherein said coacting means includes tang arm means in proximate relation to said aperture means and serrations on said leg portions for detentingly engaging said tang arm means upon insertion of said leg portions into said aperture means.

12. In a spacer assembly for use in construction applications for supporting reinforcement bar members relative to a supporting surface for concrete construction, the combination comprising:

a spacer member configured for positioning relative to the supporting surface, said spacer member having an engagement surface with saddle means for receiving a reinforcement bar member at least partially thereon a fixed distance from the supporting surface;

an extender member having a first surface configured for mating coacting engagement with said engagement surface of said spacer member, and a second displaced surface a predetermined distance from said first surface, said second surface having generally identically configured saddle means;

a unitary clamp member;

coacting means on said clamp member and said spacer member for attaching said clamp member to said space membe with said extender member atop said spacer;

means on at least one of said spacer member and said extender member for engagement with a coactingly configured portion of said clamp member for enabling retention of at least one bar member on the saddle means of said extender by said clamp.

13. The spacer member according to clamp 12 wherein said extender member is one of a plurality of extender members, each of said extender members having a different predetermined distance between said first and second surfaces thereof.

14. The spacer assembly according to clamp 12 wherein said coacting means on said member and said spacer member includes aperture means in said spacer member and arm members on said clamp member, said arm members including projections thereon for engagement with the periphery of said aperture means on insertion of said arm members therethrough.

15. The spacer assembly according to claim 12 wherein said extender member is a unitary member.

16. The spacer assembly according to claim 15 wherein said coacting means on said clamp member and said spacer member includes aperture means in said spacer member and frictionally engaging arm means on said clamp member for engagement with the periphery of said aperture means on insertion of said arm means therethrough.

17. The spacer assembly according to claim 12 wherein said means on at least one of said spacer member and said extender member for engagement with a coactingly configured portion of said clamp member includes a pair of legs on said clamp member with serrated surfaces on said legs, and slot means on said spacer member adjacent the saddle means thereof for receiving said legs, said slot means further including tang means for frictionally engaging the serrated surfaces of said legs.

18. The spacer assembly according to clamp 17 wherein said extender member includes opeinings in alignment with said slot means of said spacer member for enabling passage of the legs therethrough.

19. The spacer assembly according to claim 12 wherein said clamp member includes first means for fasteining a first bar member at least partially within said saddle means, and second means for fastening a second bar member to said spacer member in intersecting relation to and atop said first bar member.

20. The spacer assembly according to claim 12 wherein said clamp member includes a first gengerally U-shaped portion with a bight portion and first and second leg portions, and said coacting means on said clamp member and said spacer member includes first and second slot means in said spacer member for frictionally receiving said leg portions, and frictional surface means on said leg portions.

21. The spacer assembly according to claim 19 wherein said clamp member includes a first generally U-shaped portion with a bight portion and first and second leg portions, said first and second leg portions are generally parallel and spaced a distance greater than the cross-dimension of said first bar member, and wherein said first means of said clamp member includes the space between said leg portions and said bight portion.

22. The spacer assembly according to claim 21 wherein said second means of said clamp member includes hook means for engaging the second bar member.

23. In a spacer assembly for use in construction applications for supporting reinforcement bar members relative to a supporting surface for concrete construction, wherein the spacer member is configured for positioning on a supporting surface for receiving a reinforcement bar member at least partially thereon within a saddle means a fixed distance from the supporting surface, with the bar member retained on the spacer by a clamp member having leg portions frictionally engaging slot means in the spacer member adjacent the saddle means, the improvement comprising:

an extender member having a first surface configured for mating coacting engagement with the saddle means of said spacer member, and a second displaced surface a predetermined distance from said first surface, said second surface having generally identically configured saddle means, said extender member being configured for permitting the leg portions of said clamp member to frictionally engage the slot means in the spacer member for retaining a bar member within the saddle means of said extender member with said extender member within the saddle means of said spacer member.

24. The improvement according to claim 23 wherein said extender member and said spacer member are provided with coacting frictionally engaging means for securing said extender member to said spacer member.

25. The improvement according to claim 24 wherein said coacting means on said clamp member and said spacer member includes aperture means in the saddle means of said spacer member and frictionally engaging arm means on said clamp member for engagement with the periphery of said aperture means on insertion of said arm means therethrough.

26. In a spacer assembly for use in construction applications for supporting reinforcement bar members relative to a supporting surface for concrete construction, wherein the spacer member is configured for positioning on a supporting surface for receiving a reinforcement bar member at least partially thereon within a saddle means a fixed distance from the supporting surface, with the bar member retained on the spacer by a clamp member having leg portions frictionally engaging slot means in the spacer member adjacent the saddle means, the improvement wherein said clamp member is a unitary member and includes first means for fastening a first bar member at least partially within said saddle means, and second means for fastening a second bar member to said spacer member in intersecting relation to and atop said first bar member.

27. The improvement according to claim 26 wherein said clamp member includes a first generally U-shaped portion with a bright portion and first and second generally parallel leg portions spaced a distance greater than the cross-dimension of said first bar member, and wherein said first means of said clamp member includes the space between said leg portions and said bight portion.

28. The improvement according to claim 27 wherein said second means of said clamp member includes hook means for engaging the second bar member.

29. The improvement according to claim 28 wherein said hooks means includes first and second spaced hook arms integrally formed with said clamp member.

* * * * *